US005356300A

United States Patent [19]

Costello et al.

[11] Patent Number: 5,356,300

[45] Date of Patent: Oct. 18, 1994

[54] BLIND MATING GUIDES WITH GROUND CONTACTS

[75] Inventors: Brian P. Costello, Cupertino, Calif.; Robert N. Whiteman, Middletown, Pa.; Earl C. Myers, Jr., Harrisburg, Pa.; Donald T. Biechler, Harrisburg, Pa.; Robert W. Walker, Harrisburg, Pa.

[73] Assignee: The Whitaker Corporation, Wilmington, Del.

[21] Appl. No.: 122,741

[22] Filed: Sep. 16, 1993

[51] Int. Cl.[5] ..... H01R 13/652; H01R 13/629

[52] U.S. Cl. ..... 439/101; 439/378

[58] Field of Search ..... 439/101, 108, 378, 379, 439/680, 681

[56] References Cited

U.S. PATENT DOCUMENTS

| | | | |
|---|---|---|---|
| 3,178,670 | 4/1965 | Daniel et al. | 439/376 |
| 3,530,427 | 9/1970 | Stauder et al. | 439/374 |
| 3,636,503 | 1/1972 | Bernutz et al. | 439/697 |
| 3,731,259 | 5/1973 | Occhipinti | 439/378 |
| 3,987,344 | 10/1976 | Ambruoso, Sr. et al. | 439/64 |
| 4,179,178 | 12/1979 | Bachman et al. | 439/59 |
| 4,568,134 | 2/1986 | DiMondi | 439/680 |
| 4,664,456 | 5/1987 | Blair et al. | 439/108 |
| 4,776,811 | 10/1988 | Humphrey | 439/378 |
| 4,790,763 | 12/1988 | Weber et al. | 439/65 |
| 4,818,237 | 4/1989 | Weber | 439/693 |
| 4,842,543 | 6/1989 | Davis | 439/378 |
| 4,904,194 | 2/1990 | Kilsdonk et al. | 439/101 |
| 4,925,400 | 5/1990 | Blair et al. | 439/374 |
| 4,968,261 | 11/1990 | Mizunuma | 439/108 |
| 4,998,892 | 3/1991 | Shiley | 439/381 |
| 5,080,604 | 1/1992 | Rider et al. | 439/357 |
| 5,102,353 | 4/1992 | Brunker et al. | 439/608 |
| 5,178,561 | 1/1993 | Lindeberg et al. | 439/571 |
| 5,195,899 | 3/1993 | Yatsu et al. | 439/101 |
| 5,199,880 | 4/1993 | Arai | 439/65 |
| 5,211,585 | 5/1993 | Douty et al. | 439/680 |
| 5,248,458 | 9/1993 | Daly | 264/40.1 |
| 5,281,165 | 1/1994 | McCleerey et al. | 439/510 |

*Primary Examiner*—Gary F. Paumen

[57] ABSTRACT

An electrical connector assembly (1) comprises, a first electrical connector (2), electrical contacts (7) in the first electrical connector extending to a mating face (6) of the connector (2), alignment posts (12) and first ground contacts (10) along the alignment posts (12), both of which project beyond the mating face (6); and another, mating electrical connector (3) provided with post receiving cavities (11) with second ground contacts (10) in the cavities (11) engaging the first ground contacts (10) along the posts (12).

14 Claims, 3 Drawing Sheets

BLIND MATING GUIDES WITH GROUND CONTACTS

FIELD OF THE INVENTION

The invention to be described relates to an electrical connector with alignment posts that project beyond a mating face of the connector to align the mating face with another, mating electrical connector.

BACKGROUND OF THE INVENTION

According to U.S. Pat. No. 4,842,543, a known electrical connector comprises, an insulating housing having a mating face for engaging another, mating connector; electrical contacts in the housing extending toward the mating face; and posts projecting beyond the mating face. The posts serve as obstructions to protect the contacts from being damaged. The posts align the mating face with another, mating electrical connector prior to connection of the mating face with the mating electrical connector. The posts provide obstructions without a ground connection to an electrical terminal in the connector.

According to U.S. Pat. No. 4,904,194, grounding pins project from an electrical connector, and the pins incorporate springs that bias the grounding pins sideways against sides of sockets in another, mating electrical connector. The pins establish a ground connection between the connector with the mating electrical connector without establishing a ground connection to an electrical terminal in the connector.

SUMMARY OF THE INVENTION

A connector according to the invention is suitable for connecting an apparatus, such as a disk drive of a computer to a docking work station. The entire disk drive is inserted into a docking opening in the work station, which requires the connector on the disk drive to align with a mating electrical connector in the docking opening. Alignment posts on the connector project beyond a mating face of the connector on the disk drive. The alignment posts align the mating face with the mating electrical connector prior to connection of the mating face with the mating electrical connector.

Upon connection of a disk drive into a docking opening, the disk drive becomes connected to activated circuits in a docking work station. Arcing due to electrostatic discharge could result when a connector on the disk drive is connected to the activated circuits. According to a feature of the invention, electrical ground contacts on alignment posts of the connector will incur the arcing to protect the activated circuits from electrostatic discharge.

The ground contacts extend beyond the mating face of the connector. The ground contacts extend along insulating alignment posts that project beyond a mating face of a connector on the disk drive. Prior to connecting the mating face of the connector with a mating electrical connector on the docking work station, the ground contacts on the alignment posts engage the mating electrical connector. Thus, the ground contacts become engaged with the mating electrical connector before the signal contacts become engaged with the mating electrical connector. It can be said of the invention, that the signal contacts, combined with the longer ground contacts, provide at least two levels of sequenced connections with the mating electrical connector. In other words, the ground contacts first engage the mating electrical connector, and subsequently, the signal contacts engage the mating electrical connector.

Thus, according to another feature of the invention, a connector includes signal contacts and ground contacts, with the ground contacts being longer than the signal contacts and extending beyond a mating face of the connector to establish a ground connection with another, mating electrical connector, prior to connection of the mating face with the mating electrical connector.

An objective of the invention is to provide an electrical connector with ground contacts that will discharge an electrostatic charge to chassis ground potential prior in sequence to connection of other electrical contacts of the same connector with another, mating electrical connector.

Another objective of the invention is to provide an electrical connector with alignment posts and ground contacts in the alignment posts, both of which project beyond a mating face of the connector.

Another objective of the invention is to provide an electrical connector assembly, wherein a first electrical connector is provided with alignment posts and ground contacts in the alignment posts, both of which project beyond a mating face of the connector, and another, mating electrical connector is provided with post receiving channels with ground contacts in the channels engaging the ground contacts along the posts.

Another objective of the invention is to provide an electrical connector with several electrical contacts projecting forward of remaining electrical contacts to allow sequenced connection to activated circuit contacts of another, mating electrical connector.

Embodiments of the invention will now be described by way of example with reference to the accompanying drawings according to which:

DETAILED DESCRIPTION

Figure 1:
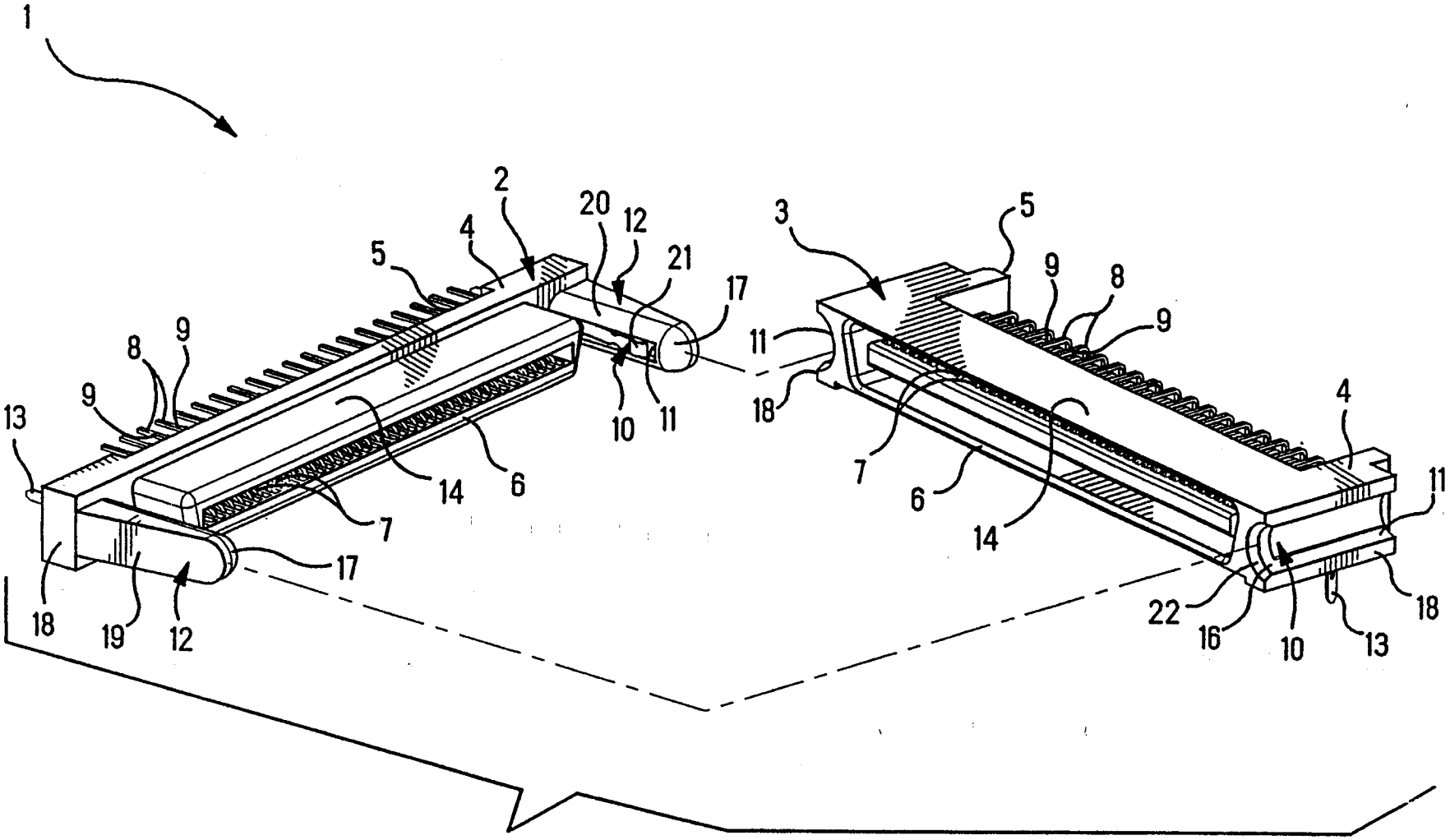
FIG. 1 is a perspective view of an electrical connector assembly comprising, an electrical connector and a mating electrical connector, with ground contacts extending along guide pins of the first electrical connector, and with ground contacts along channels in the mating electrical connector.

With reference to FIG. 1, an electrical connector assembly 1 comprises, an electrical connector 2 and another, mating electrical connector 3; each of which connectors 2, 3 comprises, an insulating housing 4 having a rear face 5 and a mating face 6; electrical contacts 7 in and extending through contact receiving cavities through the housing 4 extend from the rear face 5 toward and to the mating face 6. With respect to the connector 2 shown in FIG. 2, further details of the contacts 7 are disclosed in U.S. Pat. No. 5,281,165 issued Jan. 25, 1994.

Each electrical connector 2, 3 further comprises; electrical terminals 8 on rear ends 9 of the electrical contacts 7 that project from the rear face 5 for connection to a circuit board, not shown. Each connector 2, 3 further comprises, electrical ground contacts 10 extending in and through ground contact receiving cavities 11 in the housing 4.

The electrical connector 2 further comprises, insulative posts 12; and the conductive ground contacts 10 extending along the posts 12. The ground contacts 10 are longer than the electrical contacts 7, and extend through the housing 4 and through the rear face 5. Electrical terminals 13 on the ground contacts 10 project from the rear face 5 of the housing 4 for connection to a circuit board, not shown. The posts 12 and the ground contacts 10 project outwardly beyond the mating face 6 to establish a ground connection of the ground contacts 10. A shroud 14 on the housing 4 encircles the contacts 7 at the mating face 6. The posts 12 and the ground contacts 10 of the connector 2 project outwardly beyond the shroud 14. The ground contacts 7 project outwardly beyond the mating face 6 to engage the mating electrical connector 3 while the posts 12 engage the mating electrical connector 3.

With reference to FIG. 1, the mating electrical connector 3 comprises, the ground contact receiving cavities 11 providing sockets to receive the posts 12. The cavities 11 are in the form of channels on the mating electrical connector 3. The ground contacts 10 are in and along the channels, and face opposite open sides of the channels. Open ends 16 of the channels are spaced apart to correspond with the spacing between tips 17 of the posts 12. The ground contacts 10 in the channels receive and engage the ground contacts 10 along the posts 12 upon receipt of the posts 12 along the channels. The posts 12 project so as to align the mating face 6 of the connector 2 with the mating electrical connector 3 while the mating face 6 is spaced apart from the mating electrical connector 3. The posts 1 and the channels define opposite ends 18 of the respective, connector 12 and the mating connector 3, for example, to reduce the widths of the connectors 2, 3 to a minimum dimension from end 18 to end 18. These features of the mating connector 3 can be applied to a mating connector, not shown, for mating connection with the connector 2 shown in FIG. 2.

With reference to FIG. 1, to align the respective connectors 2, 3 end 18 to end 18 is accomplished by viewing along the posts 12 as sights to target where the posts 12 will align to assure insertion of the posts 12 into the open ends 16 of the channels. The mating connector 3 is often hidden from view inside a chassis, not shown, requiring the posts 12 to enter the chassis through an opening in the chassis. The posts 12 permit alignment of the connectors 2, 3 when the mating connector 3 is hidden from view. The posts 12 thereby facilitate blind mating connection of the connectors 2, 3. Each of the posts 12 is tapered forwardly toward the forward tip 17. Each of the posts 12 tapers inwardly along its length from the end 18 of the connector 2. A flat surface 19 on the post 12 mergers with the flat end 18 of the connector 2 and is inclined forwardly along the length of the post 12 to the tip 17. The inclined, flat surface 19 mergers with a bulbous, rounded end surface at the tip 17 of the post 12. An inward facing surface 20 of the post 12 is rounded and mergers with the flat surface 19. The inward facing surfaces 20 of the posts 12 face each other. The ground contact receiving cavity 11 is a closed end channel in the rounded surface 20 that communicates with one of the ground contact receiving cavities in the housing 4. A ground contact 10 extends within the channel and along the rounded surface at the tip 17. The post 12 partially surrounds the portion of the ground contact 10 within the channel.

Figure 4:
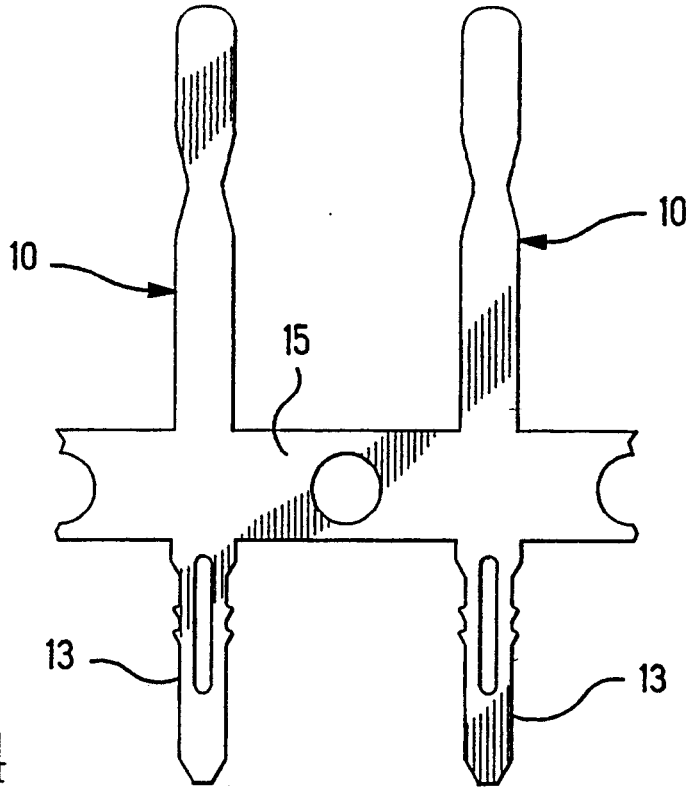
FIG. 4 is a top plan view of a metal blank form of a carrier strip that is unitary with the ground contacts for the connector as shown in FIG. 1.
Figure 5:
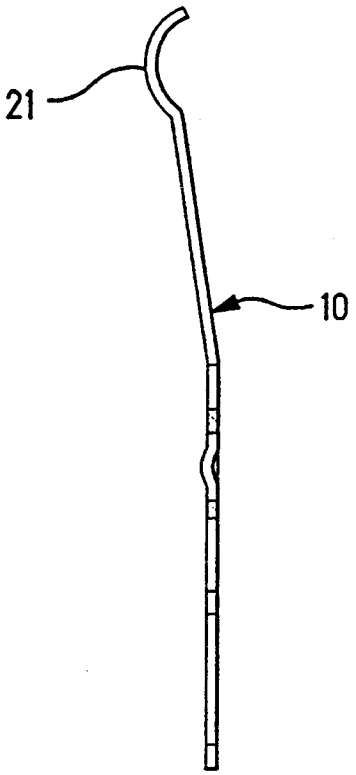
FIG. 5 is a side view of a ground contact made from the blank form shown in FIG. 3.

With reference to FIGS. 4 and 5, the ground contacts 10 are stamped and formed from a blank of metal and are unitary with a carrier strip 15, FIG. 4. Each ground contact 10 is separated from the carrier strip 23. An outwardly curved, contact surface 21 on the ground contact 10 projects outwardly of the channel to engage a ground contact 10 on the mating electrical connector 3, when the ground contacts 10 along the posts 12 are received along the channels of the mating connector 3 for connection with the ground contacts 10 in the channels of the mating connector 3.

An insulating, funnel 22 is on the open end of each of the ground contact receiving cavities 11 in the mating connector 3. The ground contact 10 in each of the cavities 11 is recessed from the open end. Because the ground contacts 10 of both connectors 2, 3 are positioned rearwardly, when the posts 12 are inserted along the cavities 11 of the mating connector 3, the open ends of the cavities 11 will be covered by the posts 12 before the ground contacts 10 of the connectors 2, 3 become engaged. Thereby, the ground contacts and the cavities 11 will be covered safely in the event that electrical arcing might occur when the ground contacts 10 of the connectors 2, 3 approach one another during mating connection.

Prior to connecting the mating face 6 of the connector 2 with the mating electrical connector 3, the ground contacts 10 on the alignment posts 12 engage the ground contacts 10 in the mating electrical connector 3. Thus, the ground contacts 10 become engaged with the mating electrical connector 3 before the electrical contacts 7 become engaged with the mating electrical connector 3. The ground contacts 10 of the mating connector 3 are connected to chassis ground, electrical potential. When the ground contacts 10 of the connectors 2, 3 are engaged, the ground connections of the connector 2 to chassis ground potential is established before the contacts 7 of the connector 2 engage the contacts 7 of the mating connector 3. It can be said of the invention, that the subsequent contacts 7, combined with the prior connection of the longer ground contacts 10, provide at least two levels of sequenced electrical connections with the mating electrical connector 3. The contacts 7 are protected from electrostatic charges when the charges are discharge to chassis ground. In addition, the connection of the contacts 7 in the respective connectors 2, 3 can be accomplished when the contacts 7 of the mating connector 3 are part of an activated electrical circuit, not shown.

A feature of the invention resides in electrical contacts 7 in the mating electrical connector 3 being engaged by the multiple electrical contacts 7 of the connector 2 subsequent in sequence to engagement of the ground contacts 10 of the respective connectors 2, 3. In other words, the ground contacts 10 of the connector 2 first engage the ground contacts 10 of the mating electrical connector 3, and subsequently, the contacts 7 engage the contacts 7 of the mating electrical connector 3. This feature discharges electrostatic charges through the engaged ground contacts 10 to isolate the electrical contacts 7 from such charges during connection and disconnect of the connector 2 and the mating electrical connector 3. The contacts 7 of the connectors 2, 3 are capable of connection and disconnect from one another while the contacts 7 of one of the connectors 2, 3 is part of an activated electrical circuit, not shown.

The connector 2 shown in FIG. 1 is capable of being modified to provide a desirable feature wherein, mating connection of the electrical contacts 7 of the connectors 2, 3 will occur in sequence. Selected electrical contacts 7 in the connector 2 are positioned forward and closer to the mating face 6 than are the remainder of the electrical contacts 7 when the connector 2 of FIG. 1 is being viewed from the mating face 6. As the connectors 2, 3 are moved toward each other for mating connection, the forward contacts 7 will engage respective contacts 7 of the other mating connector 3 before the remainder of the contacts 7 in the connector 2 become engaged with the remainder of the contacts 7 of the mating connector 3. This feature provides another level of sequenced electrical connection when the connectors 2, 3 are urged toward one another for mating connection.

Figure 2:
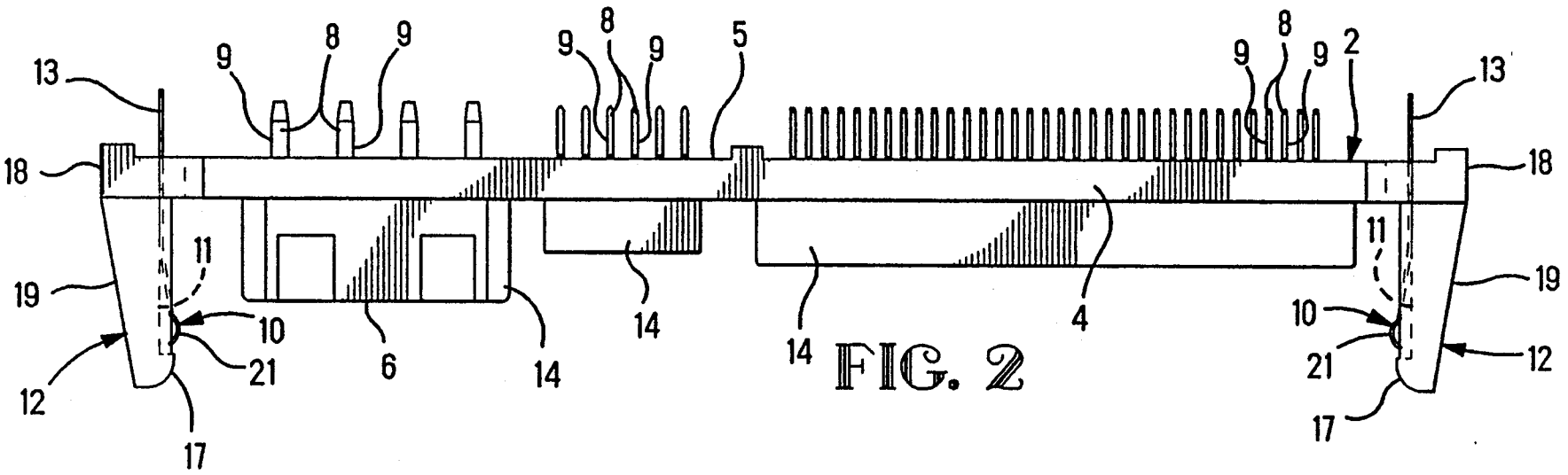
FIG. 2 is a top view of an electrical connector with alignment posts and ground contacts extending along the posts.
Figure 3:
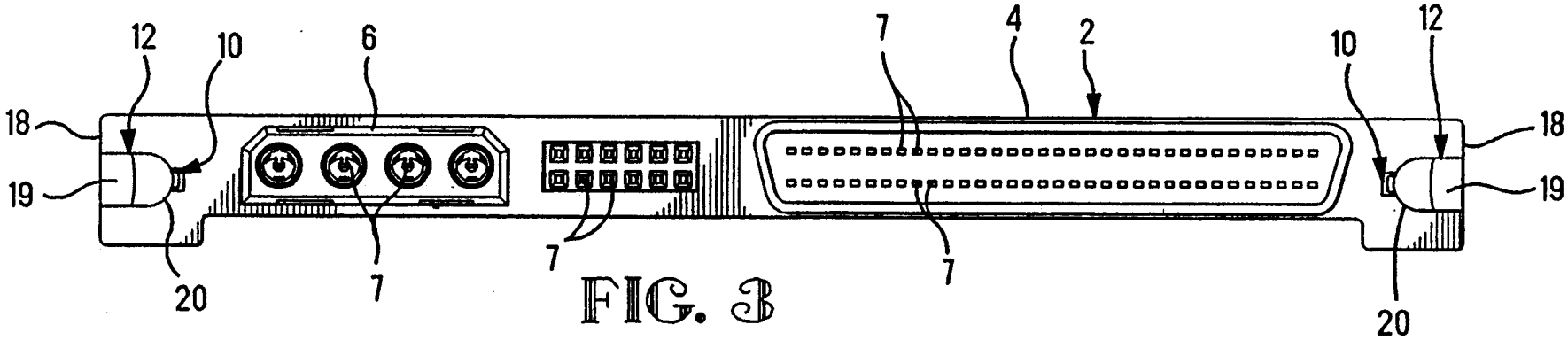
FIG. 3 is a front view of another embodiment of the connector shown in FIG. 1.

With reference to the connector 2 shown in FIG. 2, the shroud 6 is divided into several spaced apart sections, and different types of contacts 7 are encircled by the respective sections of the shroud 6. Among the different types of contacts 7, the contacts 7 that are alike are positioned forward and closer to the mating face 6 than are the remainder of the contacts 7. The contacts 7 in at least one selected section of the shroud 14 are selected to be located forward of the remainder of the contacts 7 in the remaining sections of the shroud 6. This feature provides another level of sequenced electrical connection when the connectors 2, 3 are urged toward one another for mating connection.

Other embodiments, features and advantages of the invention are intended to be covered by the spirit and scope of the appended claims.

We claim:

1. An electrical connector comprising: an insulating housing of the electrical connector having a mating face for connection with another, mating electrical connector; electrical contacts in the housing extending from the rear face toward the mating face; insulative posts; and conductive ground contacts extending along the posts; the posts and the ground contacts projecting outwardly beyond the mating face to establish a ground connection of the ground contacts with the mating electrical connector spaced apart from the mating face, and to align the mating connector with the posts while the mating face is spaced apart from the mating electrical connector.

2. An electrical connector as recited in claim 1, and further comprising: a shroud encircling the contacts at the mating face; the posts projecting outwardly beyond the shroud.

3. An electrical connector as recited in claim 1, and further comprising: surfaces of the posts facing inwardly toward each other, the ground contacts being along said surfaces of the posts.

4. An electrical connector as recited in claim 1, and further comprising: conductive terminals on ends of the ground contacts, and the ground contacts extending through the housing.

5. An electrical connector comprising: an insulating housing having a mating face for engaging another, mating electrical connector; multiple electrical contacts and ground contacts in the housing; the ground contacts being longer than the electrical contacts; the ground contacts extending beyond the mating face; insulating posts partially surrounding portions of the ground contacts; the ground contacts projecting outwardly beyond the mating face to engage a mating electrical connector while the posts engage the mating electrical connector.

6. An electrical connector as recited in claim 5, and further comprising: the posts being tapered toward tips of the posts; the posts having rounded surfaces; and the ground contacts extending along the rounded surfaces of the posts.

7. A mating electrical connector, comprising: an insulating housing having a mating face; electrical contacts in the housing extending from the rear face; channels on the mating electrical connector, and electrical ground contacts in the channels opposite open sides of the channels, open ends of the channels being spaced apart and defining post receiving sockets.

8. A mating electrical connector, as recited in claim 7, comprising: the channels being on opposite ends of the mating connector.

9. A mating electrical connector as recited in claim 7, comprising: electrical contacts in the mating electrical connector engaging the multiple electrical contacts subsequent to engagement of the ground contacts of the respective connectors.

10. A mating electrical connector as recited in claim 7, wherein, the channels are on opposite ends of the mating connector.

11. An electrical connector assembly, comprising: a first electrical connector, electrical contacts in the first electrical connector extending to a mating face of the connector, the first electrical connector being provided with alignment posts and first ground contacts in the alignment posts, the alignment posts and the first ground contacts both projecting beyond the mating face; and another, mating electrical connector provided with post receiving channels with second ground contacts in the channels engaging the first ground contacts along the posts.

12. An electrical connector assembly as recited in claim 11 wherein, selected electrical contacts in the first connector are forward of the remainder of the electrical contacts when viewed from the mating face.

13. An electrical connector assembly as recited in claim 11 wherein, the channels are on opposite ends of the mating connector.

14. An electrical connector assembly as recited in claim 11 wherein, the channels are spaced apart the same as the tips of the posts.

* * * * *